United States Patent [19]

Gomoll et al.

[11] Patent Number: 4,773,776

[45] Date of Patent: Sep. 27, 1988

[54] INK RIBBON CARTRIDGE IN A PRINTER

[75] Inventors: Guenter Gomoll, Nersingen/Leibi; Wolfgang Hauslaib, Langenau, both of Fed. Rep. of Germany

[73] Assignee: Mannesmann AG, Duesseldorf, Fed. Rep. of Germany

[21] Appl. No.: 21,455

[22] Filed: Mar. 4, 1987

[30] Foreign Application Priority Data

Mar. 4, 1986 [DE] Fed. Rep. of Germany ..... 3607081

[51] Int. Cl.[4] ..... B41J 32/00

[52] U.S. Cl. ..... 400/208; 400/243; 400/227.2; 400/215.4

[58] Field of Search ..... 400/208, 227.2, 243, 400/211, 216.4, 215.4

[56] References Cited

U.S. PATENT DOCUMENTS

| | | | |
|---|---|---|---|
| 3,349,888 | 10/1967 | Page | 400/227.2 |
| 3,819,027 | 6/1974 | Landgraf | 400/243 |
| 4,088,218 | 5/1978 | Depew | 400/208 |
| 4,610,555 | 9/1986 | DiLuco | 400/243 |
| 4,611,938 | 9/1986 | Rettke et al. | 400/227.2 |
| 4,650,355 | 3/1987 | Cassiano et al. | 400/208 |

FOREIGN PATENT DOCUMENTS

| | | | |
|---|---|---|---|
| 158963 | 9/1985 | European Pat. Off. | 400/208 |
| 213882 | 9/1984 | Fed. Rep. of Germany | 400/227.2 |
| 73986 | 4/1984 | Japan | 400/216.4 |
| 31993 | 2/1985 | Japan | 400/208 |

*Primary Examiner*—William Pieprz

*Attorney, Agent, or Firm*—Ralf H. Siegemund

[57] ABSTRACT

A ribbon cartridge may contain a single color ribbon or a multicolor ribbon, and is of wide U construction with a first pair of aligned (coaxial) pivot pins extending away from sides at locations therefrom remote from the legs of the U; a second pair of pins extends also from the sides and parallel to the first pair of pins; finally, a pair of support projections extend from the legs and also in opposite directions from the sides; the printer has two pivot mounts for receiving the pins of the first pair to thereby mount the cartridge, permitting pitch-like pivoting; in addition, the printer contains either (a) a second pair of mounts open from above for receiving the pins of the second pair, and thereby mounting the cartridge in a fixed position for single color printing, or (b) a cam shaft with at least one cam of different radial dimensions for engaging at least one of the projections such that upon turning of the cam a variable pivot-pitch is imparted upon the cartridge, the pins of the second pair being unimpeded.

2 Claims, 2 Drawing Sheets

INK RIBBON CARTRIDGE IN A PRINTER

BACKGROUND OF THE INVENTION

The present invention relates to an ink ribbon structure and device for printers, particularly matrix printers, wherein a ribbon cassette or cartridge is supported in a mounting structure on and in the frame of the printer, and wherein particularly mounting pins are provided which engage the ribbon cassette or cartridge.

Certain structures are known for the mounting of ink ribbon cassettes or cartridges which include mounting pins that extend from the broad sides of a ribbon cartridge which pins are received by appropriate slots in the frame of the printer. The front end of the cartridge cooperates with a cam structure arranged in the vicinity of the printing platen. The cam structure provides certain lifting movements imparted upon it by a cam shaft, which, in turn, is motor driven. The ribbon or cartridge may contain an endless ribbon either directly or by way of an inserted cassette which ribbon is exposed in certain portions for engagement with a drive such as a capstan or the like, and cooperating with rollers arrange inside the cassette or cartridge. Specifically, the ribbon emerges from a certain cartridge exit and is paid into the vicinity of the printing platen, passes the gap between the printing head and the platen, and re-enters the cartridge still more or less in the vicinity of the printing platen. Entrance and exit for the ribbon are particularly provided in certain projections of the ribbon cartridge. The endless ribbon, therefore, runs in a kind of closed loop. The ribbon cartridge itself is exchangable and rests on supports as stated.

European Pat. No. 158,963 discloses generally a device of the foregoing variety. In particular, that patent discloses a multi band-multi color ribbon and a cartridge for such a ribbon, for multicolored printing. The cartridge itself is maintained in the frame through a pair of aligned pins to be pivoted on the printer frame, the pivoting being such that in a kind of variable pitch one or the other of the prallel running ink bands can be put directly in alignment with the location of printing. This pitch-like movement obtains through a cam structure which includes a cam shaft being driven by an electric motor. This particular device is limited to multicolor band ribbons. For single color ribbons one needs a modified cartridge such that two different cartridges are required. This circumstance is needlessly time-consuming and expensive. A system that requires two different kinds of ribbon cartridges, moreover, increases inventory.

DESCRIPTION OF THE INVENTION

It is an object of the present invention to provide a single ribbon cartridge casing which is suitable to receive single color as well as multicolor ribbons, with a particular goal in mind that the manufacture of the ribbon cartridge is to be of a standardized or otherwise uniform construction and can be used, indeed, in conjunction with different kind of ribbons.

In accordance with the preferred embodiment of the present invention, it is suggested to provide an ink ribbon cartridge for single color ribbons as well as for multicolor ribbons which includes two pairs of mounting pins and a laterally extending cam with planar projections are provided to extend away from the broad sides of the ribbon cartridge. Such a ribbon case requires a single die casting mold; it can be filled either with a mulitcolored ribbon or a single color ribbon. The printer itself maybe provided for either single color or multicolor printing. In the single color variety two sets of open-from-above slots are provided to hold the cartridge in an invariable position. In the case of a multicolor printer, the cam structure engages the projections to pivot the cartridge about the axis of one of the sets of pins. In each of these cases, the same cartridge case is used, i.e. the printer is prepared already for the optional positioning of the same kind of case. Corresponding parts in the printer can, if necessary, easily be exchanged. It is merely necessary to replace the particular multicolor cam control for pivoting the case by a second pin support which now hold the cartridge case in a rigid position.

DESCRIPTION OF THE DRAWINGS

While the specification concludes with claims particularly pointing out and distinctly claiming the subject matter which is regarded as the invention, it is believed that the invention, the obects and features of the invention, and further objects, features, and advantages thereof will be better understood from the following description taken in connection with the accompanying drawings in which:

Figure 1:
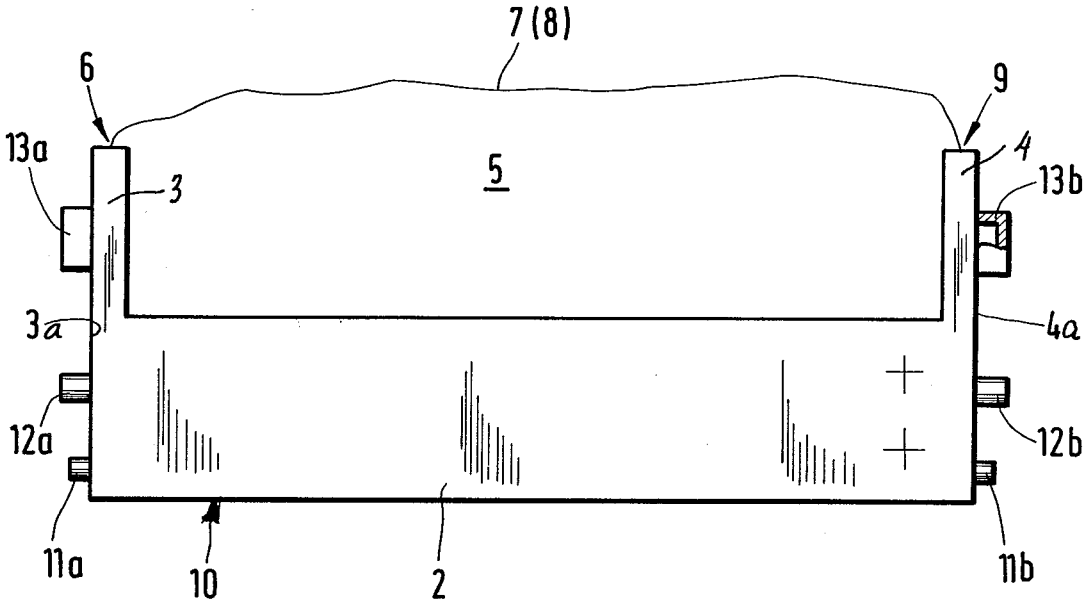
FIG. 1 is a top elevation of a ribbon cartridge constructed for mounting in accordance with the preferred embodiment of the present invention for practicing the best mode thereof.

Proceeding now to the detailed description of the drawings, a multicolor ribbon cartridge 10 is shown to have a central portion 2 which contains the bulk of the ribbon, being a multicolor ribbon or a single color ribbon. This central portion is the broad bottom of a U and a pair of legs 3 and 4 project to the left and to the right from the ends of the cartridge in between them, as well as together with the long side of center part 2, these legs enclose certain space 5. This space is provided to accommodate the print head of a printer into which this cartridge is inserted. It may include also space for the print head carriage. From an overall point of view, reference is made to FIG. 1 to the aforementioned European Pat. No. 158,963 which shows such printer, its head with a carriage, and also the overall configuration of an ink ribbon cartridge.

The cartridge contains a ribbon which may either be a multicolor ribbon 8 or a single color ribbon 7. This ribbon emerges from the cartridge in an opening 6 in leg 3, passes over and across space 5, and re-enters the cartridge at opening 9 in leg 4. Inside of the cartridge, particularly the central parts 2, the ribbon is run in a closed loop, there are bunches of the ribbon or spools or the like; the ribbon may be loosely held in the cartridge or there may be a ribbon cassette.

The ribbon is driven by means of rolls or rollers, pinch rollers or the like, which grip the ribbon in the interior of the cartridge, and in a conventional manner (not shown), a keyed shaft extends from this cartridge to connect to a drive shaft of the printer. In addition, there may be capstan rollers or the like which, in the open passage, grips the ribbon and moves the same. All these aspects are conventional.

Figure 2:
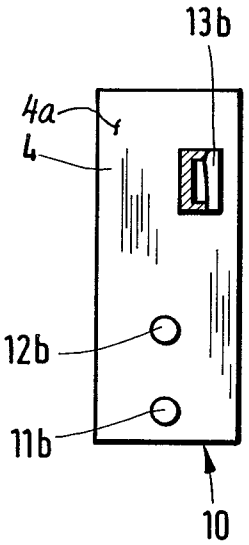
FIG. 2 is a side view of the cartridge shown in FIG. 1.
Figure 4:
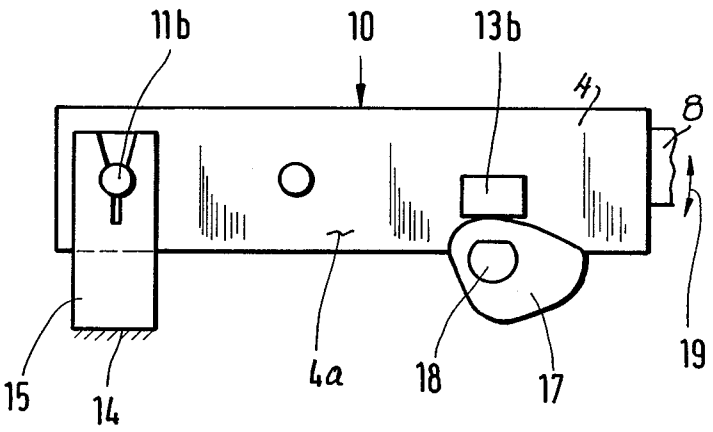
FIG. 4 is a side view of a same kind of cartridge, shown in FIGS. 1 and 2, but filled with a multicolored ribbon, the cartridge also being shown in mounting position in a multicolor printer.

The cartridge 1 is of uniform construction for all kinds of ink ribbons. The cartridge itself is provided with a first pair of coaxial mounting pins 11*a* and 11*b*, extending laterally from opposite sides 3*a* and 4*a* of the cartridge, adjacent the outer long side thereof. These pins are basically conventional for cartridges, they are the pivoted pins for obtaining the abovementioned pitch adjusting movement and positioning of a multicolor ribbon facility. Now, in additon, this cartridge has a second pair of pins 12*a* and 12*b*, extending parallel to the pins 11*a* and 11*b*, respectively, being somewhat longer as well as wider. In addition, the legs 3 and 4 of the cartridge are provided with projecting platforms 13*a* and 13*b*, the right-hand one being shown partially in cross-section; both platforms have as their main aspect a flat underside, as can be seen particularly from FIG. 2. The cartridge may be provided in addition with a cover, which is conventional and is not shown in detail.

Assuming now that the cartridge is inserted in a printer which is provided for single color or mono color printing only, then it is assumed that the frame 14 of such a printer is provided with mounts such as 15 and 16 (FIG. 3), being open and somewhat flared, as seen from above, so that the pins 11*a*, 11*b*, and 12*a* and 12*b*, can readily be inserted from above. Upon insertion the cartridge is held in a flat stationary position, which is the print position for such a cartridge in a single color environment.

Figure 3:
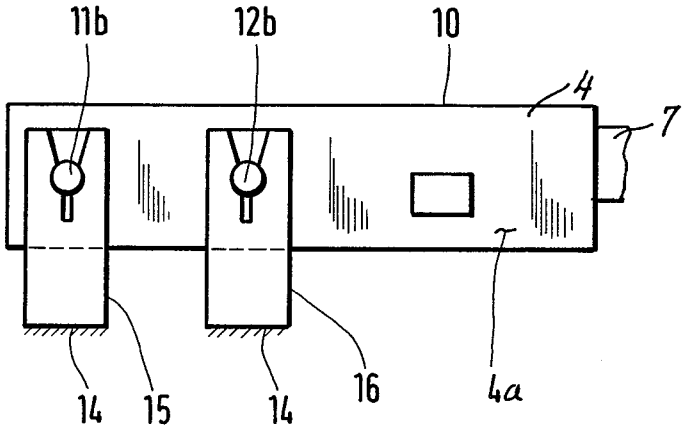
FIG. 3 is a side view of the ribbon cartridge as shown in FIGS. 1 and 2, but containing a single color ribbon, the cartridge being shown in a mounted position in a single color printer.

In the case a multicolor ribbon has been loaded into the cartridge, and if the printer is provided for multicolor printing, then it is assumed that, on one hand, there is a facility such as 15 for pivot mounting such a cartridge, and it is further assumed that there is a cam shaft 18 with a cam 17 which, upon turning, provides a variety of these vertically separate positions. Upon turning the shaft 18 by a particular angle, the cam 17 will provide a vertical lift, the height of which depends on that turning angle. The projections 13*a* and 13*b* are now provided so that one of them can bear on this cam 17. There may be two such cams, one for each projection. Therefore, upon turning the shaft 18 the cam(s) 17 will push the projection(s) up and, thereby, adjust the pitch of the cartridge vis-a-vis the pivot axis of the pins 11*a* and 11*b*, the pitch or adjustment being indicated by the double arrow 19. The pins 12*a* and 12*b* have no further function in the case of a multicolor printer, while the projections 13*a* and 13*b* have no function in single color environments, as depicted in FIG. 3.

The invention is not limited to the embodiments described above, but all changes and modifications thereof not constituting departures from the spirit and scope of the invention are intended to be included.

We claim:

1. Ink ribbon facility for printer including a ribbon cartridge which may contain a single color ribbon or a multicolor ribbon, the cartridge being of long construction resembling a wide U with legs from which the ribbon emerges respectively and re-enters the interior of the cartridge, the cartridge having sides facing away from each other, the improvement comprising:

a first pair of aligned (coaxial) mounting pins extending away from said sides at locations therefrom remote from said legs;

a second pair of pins extending from said sides and parallel to the first pair of pins;

a pair of support projections extending from the legs of said ribbon cartridge, also in opposite directions from said sides; and there being two mounts provided in the printer, being open from above for receiving said pins of the first pair to thereby mount said cartridge to the printer, permitting pitch-like pivoting, there being at least one of the following in the printer (a) a second pair of mounts open from above for receiving the pins of the second pair, and thereby mounting the cartridge in a fixed position for single color printing, and (b) a cam shaft with at least one cam of different radial dimensions for engaging at least one of said projections such that upon turning of the cam a variable pivot-pitch is imparted upon said casing, the pins of the second pair being unimpeded.

2. Ribbon cartridge having a flat, relatively long body and legs extending from the long body to obtain a cartridge being, in elevation, a wide U, having legs with sides of the cartridge, from each side extend at least two pins as well as a projection, at least one of the pins being on one end of a side of the cartridge away from the legs, the projections extending from the legs, the pins on opposite sides being coaxially aligned in pairs.

* * * * *